United States Patent [19]

Bianchi

[11] 4,311,263

[45] Jan. 19, 1982

[54] GUN SLING WITH THUMB SUPPORT

[76] Inventor: John E. Bianchi, 100 Calle Cortez, Temecula, Calif. 92390

[21] Appl. No.: 84,850

[22] Filed: Oct. 15, 1979

[51] Int. Cl.[3] ..... A41C 33/00

[52] U.S. Cl. ..... 224/150

[58] Field of Search ..... 224/149, 150, 202, 205, 224/206, 257, 258, 264, 913, 916, 917; 150/1.5 R, 1.5 B, 2, 13; 42/94

[56] References Cited

U.S. PATENT DOCUMENTS

| | | | |
|---|---|---|---|
| 1,953,933 | 4/1934 | Gundelach | 224/48 R |
| 2,985,980 | 5/1961 | Broshous | 42/94 |
| 3,052,886 | 9/1962 | White | 224/264 X |
| 3,081,923 | 3/1963 | Bagby | 224/264 X |
| 3,627,181 | 12/1971 | Bianchi | 224/150 |
| 3,759,430 | 9/1973 | Ward | 224/45 T |
| 3,882,914 | 5/1975 | Strutz | 150/1.5 R |

OTHER PUBLICATIONS

*Skateboarder,* Jan. 1978, vol. 4, No. 6, p. showing "Skateslinger".

*Primary Examiner*—Stephen Marcus
*Attorney, Agent, or Firm*—Wagner & Bachand

[57] ABSTRACT

A gun sling employing a wide shoulder portion and a narrow gun attachment portion. A transitional region between the two portions includes an aperture for the thumb of the wearer near his chest. The aperture is symmetrically located for either left or right shoulder use and is spaced from the edge of the sling by a distance consistant with the thumb-forefinger gap for comfort.

6 Claims, 6 Drawing Figures

GUN SLING WITH THUMB SUPPORT

BACKGROUND OF THE INVENTION

Gun slings for carrying rifles or long barrelled guns are nearly as old as long guns themselves. By attaching a cord or strap extending from rear end butt to the front of the stock forms a natural carrier for over the shoulder transport. The strap forms a natural bight around the wearer's shoulder to distribute the load over the shoulder, upper back, and collar bone area of the wearer.

Many gun slings have the additional duty of providing support for the shooter's forearm during shooting. These double thickness slings are most often found on target rifles.

I have found that many shooters employ the gun sling primarily for aid in carrying their rifle which may weigh as much as ten pounds. On sustained hiking the weight of the gun bearing on the collar bone can be irritating. This difficulty has been minimized through the use of sheepskin lining on the strap which provides a natural cushion. We have also widened the sling in the shoulder region. This type of widened sling is the subject of my U.S. Pat. No. 3,627,181.

Noticeable is a common practice of hunters to grasp the gun sling in the upper chest region by placing their thumb under the sling in the classic hiking pose. This serves to relieve the pressure of the strap on the collar bone and the shoulder region and provides a comfortable resting place for the hand and forearm. It also affords rapid unshouldering of the weapon.

I have found that it is possible to produce an even wider gun sling than my earlier patented design modified to provide a thumb hole located at an intermediate spacing from each edge.

The addition of a thumb hole has surprisingly provided a far superior grasping position and is more comfortable for the wearer. I have found that users of this improved gun sling immediately assume the natural grasp it provides and show amazement at the comfort. Unrecognized is a second feature of this invention which also accounts in large part for the comfort of this new gun sling.

The sling is wider than a normal sling and narrows to the common $\frac{3}{4}$ to $1\frac{1}{2}$ inch width toward each end. The narrowing region is contoured to fit the palm of the hand so the thumb hole and narrowing region conform to the shape of the hand when in a grasping condition.

BRIEF DESCRIPTION OF THE DRAWING

This invention may be more clearly understood from the following description and by reference to the drawing in which.

Figure 1:
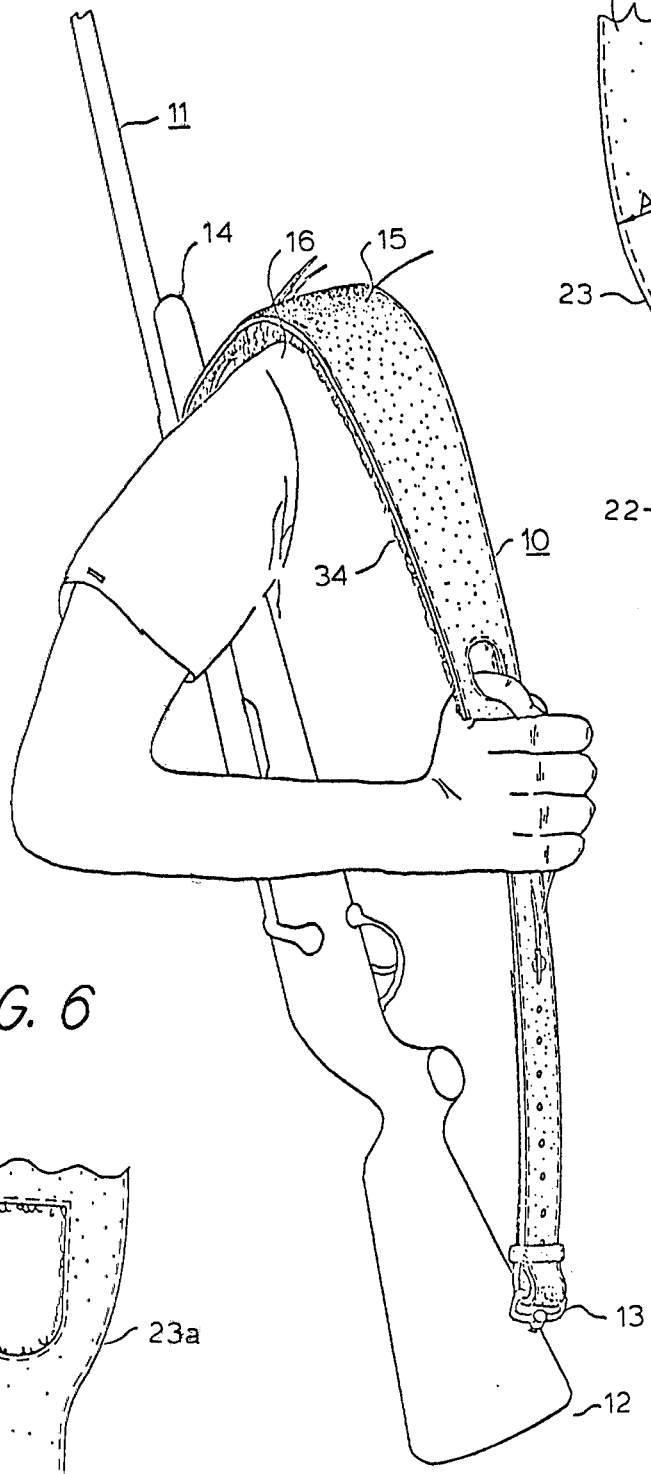
FIG. 1 is a perspective view of a gun sling of this invention in use on a hunting rifle.
Figure 2:
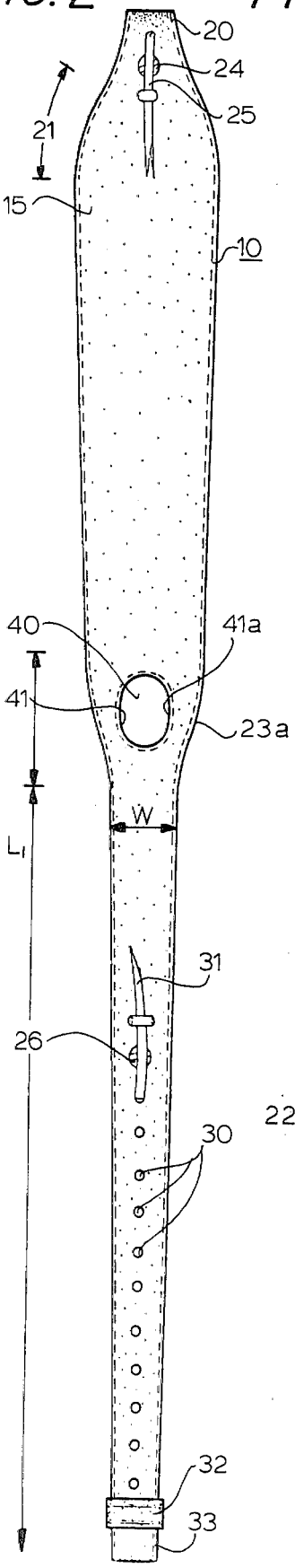
FIG. 2 is a front elevational view of the gun sling of this invention.
Figure 3:
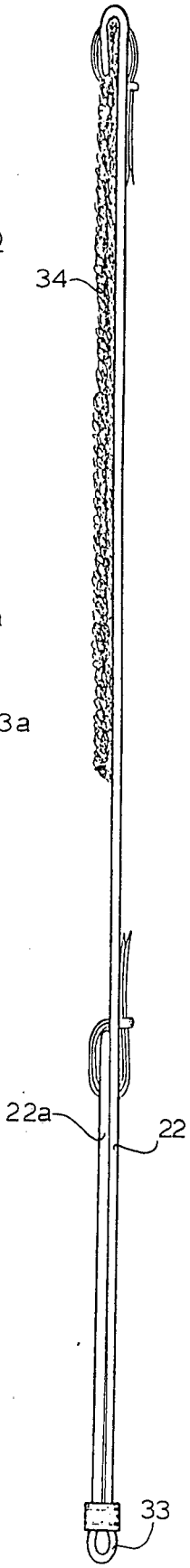
FIG. 3 is a side elevational view thereof.

Now referring to FIG. 1 an improved gun sling 10 in accordance with this invention may be seen used to carry rifle 11 by attachment to the stock 12 through a conventional swivel ring 13 at the butt end and by a similar swivel or other attachment at the upper or front end 14 of the stock 12. The sling 10 includes a broad intermediate portion 15 which at its widest point is located over the shoulder 16 of the wearer and particularly extending over the collar bone area. Preferably both ends of the sling 10 are narrowed for ease of attachment. This is best illustrated in FIG. 2 where the intermediate broad portion 15 joins the upper narrow end 20 by a smooth transitional region 21. The broad intermediate region 15 also joins the lower narrower region 22 via a second transitional region 23. The upper ends include a suitable fastener such as a screw 24 protected from abrading any metal or wood parts of the weapon by leather thong 25. The lower region 22 of the sling is adjustable in length via movement of locking screw 26 which extends through a single opening in the under side portion 22A appearing in FIG. 3 and through the selected one of a number of openings 30 in the front face of the sling 10. Locking screw 16 has a similar protecting thong 31 comparable to thong 25. A leather slide 32 encircles the end loop portion 33 at the bottom on the sling in order to keep the sections 22 and 22A together and particularly to limit the size of loop 33. As is apparent in FIGS. 1 and 3 and particularly in FIG. 4, the underside of the intermediate portion 15 has a cushion layer 34 which preferably is sheep skin.

Now your attention is directed again to FIG. 2 and the transitional region 23 between the broad intermediate portion 15 and the narrower end region 22 of the sling. The transition region 23 is defined by a smooth compound curve. Positioned between the corresponding opposite compound curves 23 and 23A is an opening 40 dimensioned to receive the thumb of the wearer inserted from the underside of the sling as illustrated in FIG. 1. The thumb hole 40 is preferably oval in shape but at least is concave in the regions 41 and 41A opposite the respective transition region 23 and 23A. The wall thickness of the leather strap in the transition region 23 and 23A is in the order of one-half to three-fourths inches. This distance is related to the depth between the thumb and forefinger of the wearer when his hand is in a gripping position shown in FIG. 1. This provides an extremely comfortable hand carrying position.

The upper end of region 22 has a width W as shown in FIG. 2, related to the opening between the fingers and the palm of the hand when in the grasping position shown in FIG. 1. It is apparent that by the use of this transitional region, I have developed a hand hold which is comfortable and thumb hole 40 at the correct position to allow the thumb to extend through the sling comfortably. The positioning of the opening in a thumb hole not only provides these appropriately shaped grasping points but additionally provides an aesthetically pleasing design for a gun sling which is the subject of my co-pending ornamental design application, Ser. No. 34,158 filed Apr. 27, 1979. Apart from the ornamental aspects of the thumb hole, the inter-relationship of location dimensions of the wall defining the thumb hole 40, the shape of the transition region 23 and the dimension W of the length L all cooperate to provide the extremely comfortable hand hold for the sling. An ancillary advantage of this invention is that the width of the broad portion 15 of the sling is no longer limited by the need to provide a hand grasp point for the sling.

Figure 4:
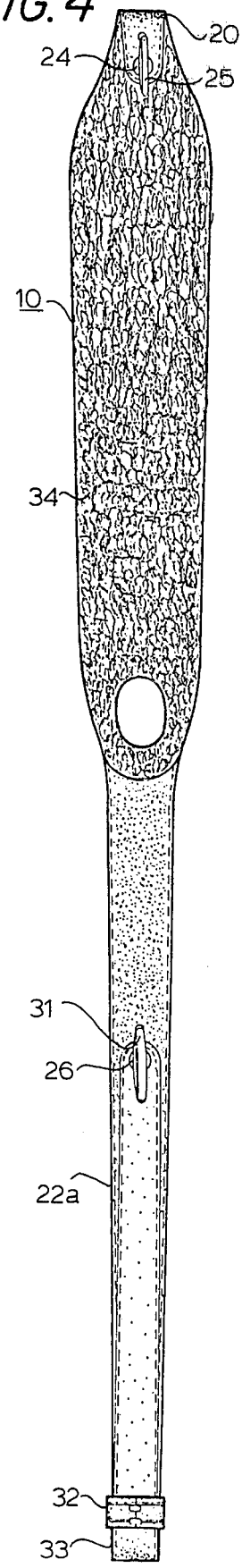
FIG. 4 is a rear elevational view thereof.

The drawing FIG. 4 shows the rear side of the sling 10 and illustrating the upper bight 20, securing screw 24 and protective thong 25. FIG. 4 also gives a clearer view of the tail end 22A a thong 31 and attaching screw 26. FIG. 4 gives the best view of the sheepskin lining.

Figure 5:
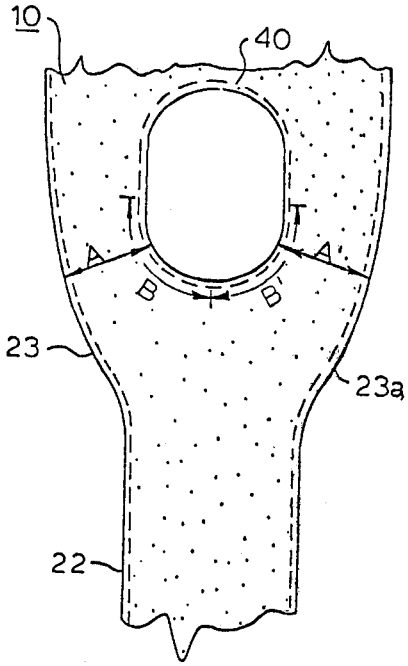
FIG. 5 is an enlarged fragmentary front elevational view showing the details of the thumb hole.
Figure 6:
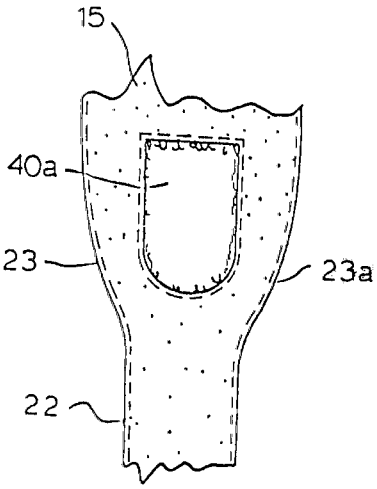
FIG. 6 is an enlarged fragmentary front elevational view of an alternate embodiment of this invention.

FIG. 5 is a greatly enlarged fragmentary view of the transitional region 23 showing a portion of the thumb hole 40 and illustrating the dimension A corresponding to distance between the thumb and the forefinger of the wearer. Curves B and B1 are the mating curves of the thumb allowing for broad area distribution of the thumb pressure on the sling. It should be noted that the only grasping region used of the thumb hole 40 is the lower regions B or B' depending upon which shoulder is used for carrying and which thumb is inserted through the thumb hole 40. The upper configuration of the thumb hole is not critical. Thus it can be angular and such an arrangement is illustrated in FIG. 6 where the thumb hole 40A is curved at its lower region but is rectangular or of other shape at its upper end.

Through the interrelationship between the size and shape of the thumb hole 40 and the transitional region 23 of the gun sling, a natural hand hold at the appropriate position on the gun sling is achieved. With this hand hold the intermediate portion 15 may be as broad as desired thus spreading the load on the wearer's shoulder and allowing heavy weapons to be carried with comfort. Psychologically the natural grasp on the sling and comfortable contact with the sling leather gives a feeling of security and confidence to the wearer unfound in slings prior to this invention. An additional side advantage: the thumb extending through the sling is a point for positive control during rapid unshouldering of the sling. Each of these advantages are directly related to the features mentioned above.

The above described embodiments of this invention are merely descriptive of its principles and are not to be considered limiting. The scope of this invention instead shall be determined from the scope of the following claims, including their equivalents.

What is claimed is:

1. A gun sling comprising an elongated member of leather or leather-like material including attachment points at opposite end regions for securing to two spaced portions of a long gun;

said gun sling including intermediate broader width portion positioned to provide the contact area for the shoulder of the wearer;

said sling including a narrower lower portion for engagement with the butt region of the long gun to be carried in the sling; and said sling defining a thumb hole extending through said sling in the region between intermediate broader region and the narrower lower region of the sling.

2. The combination in accordance with claim 1 wherein said thumb hole includes curved surfaces for mating with the wearer's thumb at the lower area of said thumb hole.

3. The combination in accordance with claim 2 wherein said thumb hole is equal distance from opposite edges of said sling.

4. The combination in accordance with claim 1 including transitional region including broader intermediate region and the narrower lower region of the gun sling;

said transitional region having a convex contour in the region adjacent to said thumb hole to mate with the palm of the hand of the wearer.

5. The combination in accordance with claim 4 wherein the width of material between said transition region and said thumb hole corresponds to the distance between the thumb and forefinger of the wearer when the hand is in the grasping position, and circling the lower region of said sling.

6. The combination in accordance with claim 1 wherein said lower region of said sling corresponds in width W at least in the region immediately below the thumb hole to the finger grasp of the wearer.

* * * * *